US008833050B2

(12) United States Patent
Kurosawa et al.

(10) Patent No.: US 8,833,050 B2
(45) Date of Patent: Sep. 16, 2014

(54) DOUBLE RUSTPROOF PC STRAND

(71) Applicant: Kurosawa Construction Co., Ltd., Tokyo (JP)

(72) Inventors: Ryohei Kurosawa, Tokyo (JP); Kei Hirai, Tokyo (JP)

(73) Assignee: Kurosawa Construction Co., Ltd., Tokyo (JP)

( * ) Notice: Subject to any disclaimer, the term of this patent is extended or adjusted under 35 U.S.C. 154(b) by 0 days.

(21) Appl. No.: 13/740,526

(22) Filed: Jan. 14, 2013

(65) Prior Publication Data

US 2013/0269308 A1 Oct. 17, 2013

(30) Foreign Application Priority Data

Apr. 12, 2012 (JP) ..... 2012-090872

(51) Int. Cl.

| | |
|---|---|
| ***D07B 1/06*** | (2006.01) |
| ***D07B 1/02*** | (2006.01) |
| *D07B 7/18* | (2006.01) |

(52) U.S. Cl.

CPC ..... *D07B 1/02* (2013.01); *D07B 2201/2006* (2013.01); *D07B 2201/2011* (2013.01); *D07B 2205/3064* (2013.01); *D07B 2301/10* (2013.01); *D07B 2201/2051* (2013.01); *D07B 2201/2012* (2013.01); *D07B 2205/3071* (2013.01); *D07B 2201/2046* (2013.01); *D07B 2205/306* (2013.01); *D07B 1/0693* (2013.01); *D07B 2201/2013* (2013.01); *D07B 2207/4059* (2013.01); *D07B 7/18* (2013.01); *D07B 2201/2065* (2013.01); *D07B 2201/2044* (2013.01); *D07B 2501/2023* (2013.01); *D07B 2205/3067* (2013.01); *D07B 2301/45* (2013.01); *D07B 2401/2025* (2013.01); *D07B 2207/404* (2013.01); *D07B 2201/2059* (2013.01)

USPC ..... 57/223

(58) Field of Classification Search

USPC ..... 57/212, 223, 232, 241, 258; 427/175

See application file for complete search history.

(56) References Cited

U.S. PATENT DOCUMENTS

| | | | | |
|---|---|---|---|---|
| 3,847,002 | A * | 11/1974 | Suzuki et al. | 72/128 |
| 5,208,077 | A * | 5/1993 | Proctor et al. | 427/461 |
| 5,263,307 | A * | 11/1993 | Hasui | 57/221 |
| 5,362,326 | A | 11/1994 | Hasui et al. | |
| 7,241,473 | B2 * | 7/2007 | Hasui et al. | 427/175 |
| 7,861,507 | B2 * | 1/2011 | Maekawa et al. | 57/212 |

FOREIGN PATENT DOCUMENTS

| | | |
|---|---|---|
| JP | 11-200267 | 7/1999 |
| JP | 2004-263320 | 9/2004 |
| WO | 92/08551 | 5/1992 |

* cited by examiner

*Primary Examiner* — Shaun R Hurley

(74) *Attorney, Agent, or Firm* — Wenderoth, Lind & Ponack, L.L.P.

(57) ABSTRACT

A double rustproof PC strand has superior durability and semi-permanent rustproof performance. A core wire and surrounding wires are formed of wires subjected to a wire drawing treatment and a plating treatment to be formed with a plated layer. A rustproof treatment is applied by forming a synthetic resin coat on an outer peripheral surface thereof. In order to uniformize and regulate the twisting pitch, the core wire and the surrounding wires are adjusted under the conditions of:

(A) Diameter of CORE: 4.42±0.05 mm, Diameter of Surrounding wire: 4.25±0.05 mm, (B) Diameter of CORE: 5.22±0.05 mm, Diameter of Surrounding wire: 5.06±0.05 mm, or (C) Diameter of CORE: 5.40±0.05 mm, Diameter of Surrounding wire: 5.25±0.05 mm, and then twisted, and the tensile strength is 1850 N/mm$^2$ or higher.

6 Claims, 7 Drawing Sheets

DOUBLE RUSTPROOF PC STRAND

BACKGROUND OF THE INVENTION

1. Field of the Invention

The present invention relates to a PC strand manufactured by coating a core wire and surrounding wires of a PC strand used as tensioning member or stay cable for post-tensioning or pre-tensioning in prestressed concrete used for structures such as architectural constructions and civil engineering structures, or of a PC strands used as stay member or stay cable for marine structures and cable-stayed bridges susceptible to salt corrosion with a plated layer and a synthetic resin coating by a double rustproof processing treatment.

2. Prior Art

In general, a PC strand has a structure having plural surrounding wires twisted around a core wire. The reason for using such a structure is to impart flexibility to the PC strand, and to form helical grooves with the twisted surrounding wires and thus provide a sufficient shear resistance for wires embedded in concrete. Accordingly, there is a need for a treatment method for the PC strand applied with the rustproof processing that does not interfere with these characteristics. In actuality, several PC strands applied with the rustproof processing treatment and rustproof processing treatment methods are known.

As a first known prior art, there is a corrosion-resistant composite member (WO92/08551), which is a corrosion-resistant member having an enhanced resistance with respect to fatigue breakdown, including strands formed of high-strength steel wires, formed with a substantially impermeable, continuous and firm adherent coating of epoxy-based resin on an outer surface of the strand, and filled with the epoxy resin in internal gaps between adjacent steel wires abutting with each other. Accordingly, bending rigidity of the strand is increased, relative movement between the steel wires of the strand is reduced, and a resistance against breakdown due to bending fatigue or chafing fatigue is enhanced. Consequently, the coating and the filling are kept adhered integrally with the strand and its steel wires when being subjected to winding or bending, and when tensed and expanded.

The corrosion-resistant composite member is exposed to the cloud of epoxy-based resin powder charged with static electricity containing air in a temporarily opened state, whereby the bear core wire and surrounding wires are individually coated and the coating material works as a filling material or an impregnating material for gaps or voids when the strand is closed to its original shape immediately thereafter and hence is impregnated in and coated completely on the strand, thereby enhancing the corrosion resistance and, simultaneously, resisting the relative movement of the wires, and increasing bending rigidity which reduces the chafing fatigue and reduces the bending fatigue.

As a second known prior art, there is a method of forming and processing rustproof coatings on PC strand (U.S. Pat. No. 5,362,326A) including temporarily untwisting the PC strand in sequence, maintaining a spread state by the spread maintaining units, adjusting an excess part of the core wire, forming synthetic resin powder coating adherent films on the entire outer peripheral surfaces of the core wire and the surrounding wires of the untwisted portions respectively, heating and welding the adherent films to form coatings on the entire outer peripheral surfaces of the core wire and the surrounding wires respectively, cooling the coatings, and re-twisting the core wire and the surrounding wires.

The PC strand formed in this manner is not subjected to impairment of the characteristics required as the PC strand such as flexibility and shear resistance with respect to concrete because the coatings are formed individually on the respective core wire and surrounding wires over the entire outer peripheral surfaces thereof and, in addition, the rustproof function is sufficient. Therefore, this rustproof method is evaluated to be an ultimate rustproof method for the PC strand.

As the thickness of the coat of this type, in order to satisfy corrosion-resistant performances and dynamic performances (shock resistance, bending property, or adhesive property for concrete), a thickness of 200±50 μm is reported to be suitable for the coat formed of a powder-type epoxy resin according to many results of study, and a range of approximately 170±50 μm is reported to be preferable according to the result of experiment conducted by FHWA (Federal Highway Administration) of the United States of America.

As a third known prior art, there is a method of forming double coatings on a PC strand including untwisting surrounding wires of the PC strand temporarily from the core wire in sequence, and in the untwisted state, forming a rustproof coating on the entire outer peripheral surfaces of the core wire and the surrounding wires respectively, twisting the surrounding wires on the core wire again while integrating and absorbing an excess part of the core wire generated by an increase in diameter, then further forming a coating thereon, which is a method of forming double coatings by forming additionally a thick coating on the outer peripheral surface of the PC strand of the first prior art in a case where there is a risk of occurrence of damage of the rustproof coating used in a special structure and a film thickness of 250 μm or larger which is a maximum thickness of coating which can be stably held, is required (JPA_1999200267).

Furthermore, as a fourth known prior art, there is a method of forming a rustproof coating including forming a PC strand after having applied a wire drawing treatment to plated wires, untwisting the PC strand to apply a blast treatment on a core wire and surrounding wires, forming resin coatings on the outer peripheral surfaces of the core wire and the surrounding wires applied with the blast treatment, and twisting the core wire and the surrounding wires again after having cooled the resin coatings (JPA_2004263320).

With this method, by the application of the blast treatment to the core wire and the surrounding wires formed with plated coatings, the adhesive property of the resin coating with respect to the plated coatings of the core wire and the surrounding wires is improved, and the rustproof performance of the resin coatings is improved.

In the first to third prior arts described above, the rustproof coating is formed by temporarily untwisting and spreading the twisted portion of the PC strand in sequence, feeding the same in sequence while keeping the spread state, causing the synthetic resin powder coating material to be adhered to the entire outer peripheral surfaces of the core wire and the surrounding wires, heating and melting the adhered coating material, and forming the synthetic resin coating as a rustproof film. However, there is a risk of damage being formed to the surface of the film such as partial peel-off or scratch of the synthetic resin coating due to reception of an external force during transport, unloading or insertion of cable into a sheath at the time of construction. There is a problem in that the steel wire in the interior may be eroded if water drops containing salt enters from the partial surface damage portion or a pinhole when the PC strand having such surface damage generated thereon is used as a cable for a material to be placed in a tense state or a cable-stay material for marine structures or cable-stayed bridges.

In the fourth prior art described above, usage of the PC strand in which the core wire and the surrounding wires are untwisted and plated is disclosed. However, the adequate thickness of the plated core wire and surrounding wires, that is, adequate diameters of the respective wires are not figured out at all. Therefore, twisting pitches of the surrounding wires with respect to the core wire may become short or long, that is, uneven, and there may arise a case where a part of the twisted surrounding wire is twisted without coming into contact with the core wire (state of being separated therefrom). In any cases, there is a problem in that when a predetermined tensile strength is applied thereto at the time of usage as the PC strand, a tensioning force caused by the tensile force is intensively applied to a part of the core wire or the surrounding wires, so that the corresponding part may be expanded or broken, and hence the tensile strength equivalent to a bear PC strand having no coating cannot be obtained.

By the way, a plated layer of a steel material, for example, galvanization is a rustproof means having two effects; namely a coating action and a sacrificial anode action, and is a depleting material which is gradually depleted when exposed in the atmosphere. Since the coating of the galvanization is bound with oxygen, the layer has a high density, so that a high rustproof effect is expected by coating the surface thereof or the like. In addition, although the galvanization itself goes rusted (gradually dissolved) by contact with moisture as an object of rusting, the steel material is protected by its sacrificial anode action. In other words, it is a self-sacrificial anticorrosive effect that is dissolved self-sacrificially and prevents generation of red rust of the steel material. Even if a part of the plated layer has got damaged, the damaged portion is protected by the sacrificial anode action of the plated coating therearound. Therefore, formation of rust on damaged portion as in the case of coating does not occur. Being superior in bendability, the flexibility as a characteristic of the PC strand and the stability of fixing performance are secured, and hence the galvanization is used often as the rustproof material for the PC strand.

However, since the galvanization is depleted, a permanent effect is not expected. Although the problem does not occur in ten to twenty years in a normal environment, rust may be formed in approximately two to three years in an undesirable environment such as marine or coast. The thicker the galvanization layer, the more the rustproof becomes effective. However, since the surrounding wires are twisted around the core wire in the PC strand, if a thick plated layer is formed on the outer periphery of the wires of the PC strand, a thickness six times as much as the plated layer affects on the outer diameter of the PC strand, which is not up to the standard. Therefore, the thickness of the plated layer cannot be increased more than is necessary. Furthermore, the twisting pitches of the core wire and the surrounding wires may become short or long, that is, uneven, because the wires cannot be twisted with regular pitches unless the diameter of the core wire is set to be slightly larger than the diameter of the surrounding wires. Consequently, there arises a problem that an intensive tensile force is applied to the core wire or a part of the surrounding wires and hence the wires are partially expanded or broken, that is, the general strength thereof as the PC strand is lowered.

Therefore, in the PC strand of the prior art, it is an object to improve and stabilize the tensile strength as the PC strand to allow a long term use by preventing corrosion due to the entry of water drops from the partial surface damage portion of the rustproof coating or from a pinhole, or by preventing the winding pitches of the surrounding wires from becoming uneven by setting the diameters of the core wire and the surrounding wires respectively so as to make the winding pitch of the surrounding wires with respect to the core wire constant.

SUMMARY OF THE INVENTION

As a first aspect of the invention, there is provided a double rustproof PC strand formed with a synthetic resin coating on an outer peripheral surface thereof and subjected to a rustproof treatment: including: a core wire and surrounding wires, each wire of which being formed with a plated layer by being subjected to a wire drawing treatment and a plating treatment and then twisted, wherein the respective wires are adjusted under adjustment conditions of (A) diameter of the core wire: 4.42±0.05 mm, diameter of the surrounding wire: 4.25±0.05 mm;

(B) diameter of the core wire: 5.22±0.05 mm, diameter of the surrounding wire: 5.06±0.05 mm; or (C) diameter of the core wire: 5.40±005 mm, diameter of the surrounding wire: 5.25±0.05 mm, and the tensile strength is 1850 N/mm$^2$ or higher.

As a second aspect of the invention, there is provided the double rustproof PC strand according to the first aspect of the invention, wherein gaps between the respective wires formed with the plated layer are filled with synthetic resin.

As a third aspect of the invention, there is provided the double rustproof PC strand according to the first aspect of the invention, wherein the respective wires formed with the plated layer are each formed with the synthetic resin coating on the outer peripheral surface thereof.

As a fourth aspect of the invention, there is provided the double rustproof PC strand according to the first or second aspect of the invention, wherein the thickness of the synthetic resin coat is at least 400 μm.

As a fifth aspect of the invention, there is provided the double rustproof PC strand according to the third aspect of the invention, wherein the thickness of the synthetic resin coat is at least 120 μm.

According to the double rustproof PC strand in the invention, the core wire and the surrounding wires are adjusted to preset different diameters respectively and are formed to have a double rustproof layer structure by forming the synthetic resin coat on the plated layer. Therefore, the core wire and the surrounding wires complement one another and the durability of the PC strand is improved. In other words, the configuration in which the lack of the rustproof function due to partial surface damage of the synthetic resin coating formed on the outer peripheral surface or a pinhole, if any, is compensated by the plated layer is achieved. In addition, by forming the core wire and the surrounding wires to have preset different diameters, the twisting pitch can be uniformized and regulated, so that the entire strength as the PC strand, that is, the tensile strength is improved to and stabilized at 1850 N/mm$^2$ or higher. Although the plated layer on one hand is formed of depleting material depleted when exposed in the atmosphere, the synthetic resin coat on the other hand is not a depleting material and is relatively high in durability. Therefore, with the double rustproof structure having the synthetic resin coating overlapped on the plated layer, the synthetic resin coating protects the depleting property of the plated layer, and the plated layer contributes to the rustproof of the steel wire. Therefore, the superior durability and substantially semi-permanent rustproof performance are exercised, so that a superior effect of dramatically improving the service life is achieved.

DETAILED DESCRIPTION OF THE PREFERRED EMBODIMENTS

Figure 1:
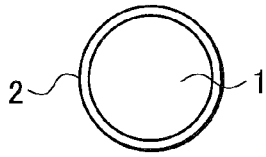
FIG. 1 is an enlarged cross-sectional view showing a wire used for a PC strand and having subjected to a wire drawing treatment and a plating treatment according to the invention.
Figure 2:
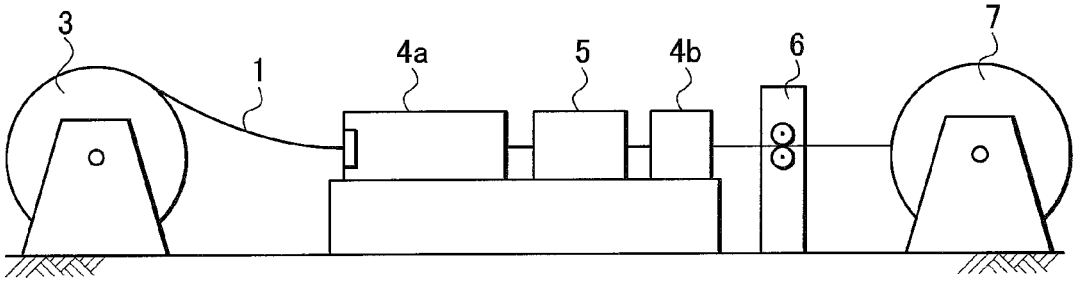
FIG. 2 is a schematic side view showing a process of the wire drawing treatment and the plating treatment of the wire.

Referring to embodiments shown in the drawings, the invention will be described in detail. First of all, referring FIGS. 1 and 2, processes of a wire drawing treatment and a plating treatment to be performed on a wire 1 to form a plated layer 2 on an outer peripheral surface subjected to a primary rustproof plating treatment will be described. The wire 1 to be subjected to the wire drawing treatment and the plating treatment has a diameter of approximately 10 to 15 mm and a length exceeding 100 m and is wound on a reel 3. The wire 1 is forcedly unwound from the reel 3 by a roll 6 via a first wire drawing treatment process 4*a*, a plating treatment process 5, and a second wire drawing treatment process 4*b* and is drawn and is subjected to a plating treatment, and the drawn and plated wire 1 is wound in sequence by a reel 7.

In the wire drawing treatment processes 4*a*, 4*b*, the wire is subjected to a drawing process to be drawn into a predetermined diameter by being subjected to a cold drawing process via plural dies reduced in hole diameter in sequence. For example, six to seven or more phases of the drawing dies are used in the first wire drawing treatment process 4*a*, and two or three phases of the drawing dies are used in the second wire drawing treatment process 4*b* so as to reduce the squeezing amount, that is, the amount of reduction in diameter in every phase to achieve diameter reduction and wire drawing gradually. In the plating treatment process, a melting plating unit is used to allow the wire to pass through a high-temperature galvanization bath in a melted state, so that the uniform plated layer 2 is formed on the surface of the wire 1. Although not illustrated, cleaning units for the wire 1 are provided before the respective processes, and the wire 1 is cleaned and cooled by the cleaning units.

Since the wire 1 is tempered and hence the orientations of the molecules become non-uniform by being heated in the plating treatment process, the tensile strength is lowered. Therefore, the process of drawing the wire 1 again after the formation of the plated layer 2 includes aligning the orientation of the molecules by expanding in the second wire drawing treatment process, that is, an orientation is performed, and a drawing process is performed so as to avoid generation of fine cracks like wrinkles. In addition to the galvanization, the plating treatment includes zinc alloy plating, aluminum alloy plating, copper plating, and chrome plating.

Figure 3:
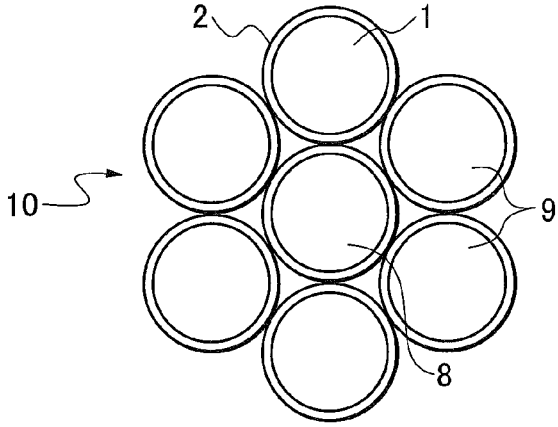
FIG. 3 is an enlarged cross-sectional view of a PC strand having plated layers formed by twisting the wires after having subjected to the wire drawing treatment and the plating treatment in the process shown in FIG. 2.

The wire 1 after having been subjected to the drawing process is processed into a strand state by a generally-used PC strand processing device for seven-wire strands. As shown in FIG. 3, for example, a PC strand 10 having a predetermined outer diameter is obtained by twisting six surrounding wires 9 around one core wire 8 with a predetermined twisting pitch. For example, in order to make the diameter of the processed PC strand 10 fallen within a predetermined range as a standard product, the twisting pitch of the core wire 8 and the surrounding wires 9 is required to be uniform and constant. The twisted elongated PC strand 10 is wound around a required reel.

The PC strand 10 used here has the core wire 8 formed to have a diameter slightly thicker than that of the surrounding wires 9. The reason is that when an attempt is made to twist the surrounding wires 9 around the core wire 8 with a predetermined twisting pitch, the surrounding wires 9 are wound helically on an outer peripheral surface of the core wire 8. However, since the diameter of the core wire 8 is formed to be slightly thicker, all the surrounding wires 9 come into contact integrally with the outer peripheral surface of the core wire 8 by the uniform twisting force, and the contact between the outer peripheral surfaces of the surrounding wires 9 is not too tight but has a certain allowance, whereby the uniform twisting pitch is enable and the strength is improved with a tensile strength of 1850 $N/mm^2$ or higher.

In contrast, for example, even when the wires having the same diameter a used for the core wire 8 and the surrounding wires 9 and the both are twisted with a regular pitch with the PC strand processing device, the wires are not necessarily twisted with the outer peripheral surfaces thereof in contact with each other. The reason is that the diameters of the drawn wires are not uniform since the wires are generally susceptible to environmental (season and temperature) and mechanical (state of dies, frictional heat, etc.) processing errors in the wire drawing treatment process, and hence such events that when the twisting process is performed, the outer peripheral surfaces of the surrounding wires 9 come into excessive contact with each other and hence parts of the surrounding wires 9 do not come into contact with the outer peripheral surface of the core wire 8 and parts of the surrounding wires 9 come into contact with the core wire 8 with the excessive twisting force, and hence the wires cannot be twisted with a uniform twisting pitch and hence are twisted irregularly occur. Accordingly, the tensile force applied to the surrounding wires 9 varies and hence a problem of lowering of the strength as the PC strand 10 occurs.

Therefore, when forming various PC strands 10 different in thickness according to requirements in the market, in order to obtain the PC strands superior in strength (having a tensile strength of 1850 N/mm$^2$ or higher) by twisting the surrounding wires 9 on the core wire 8 with a uniform twisting pitch, the diameters of the core wire 8 and the surrounding wires 9 are needed to be adjusted under the conditions of (A), (B), or (C) shown below, respectively in the above-described wire drawing treatment process. The unit of numerical values is millimeter, and ±0.05 is included in the allowable error.

(A) Diameter of the core wire: 4.42±0.05, Diameter of the surrounding wire: 4.25±0.05

(B) Diameter of wire: 5.22±0.05, Diameter of the surrounding wire: 5.06±0.05

(C) Diameter of the core wire: 5.40±0.05, Diameter of the surrounding wire: 5.25±0.05

Figure 4:
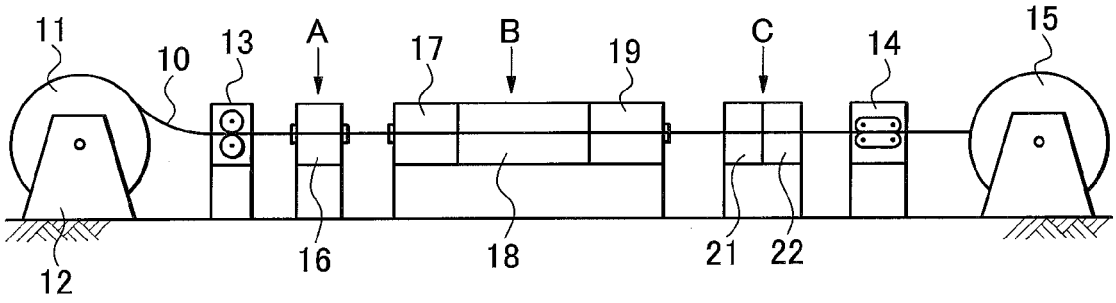
FIG. 4 is a schematic side view showing a process of forming a secondary rustproof coating on the PC strand according to a first embodiment of the invention using the PC strand having the plated layers.

Subsequently, a process of farming and processing a secondary rustproof resin coating on the surface of the primary rustproof plated layer 2 will be descried with several embodiments. As regards the process of the processing line according to a first embodiment, as shown in FIGS. 4 and 5, a mount 12 on which the PC strand 10 wound on a reel 11 is set is provided on the beginning end side, and the PC strand 10 set on the mount 12 is fed in sequence toward the respective processes for the rustproof coat forming and processing at a constant speed set on a pinch roll 13.

The process includes winding on a winding reel 15 on the terminal side of a drawing unit 14 after having been subjected to a pretreatment process A, a coating process B, and an inspection process C. The pretreatment process A includes a cleaning device 16. The cleaning device 16 used here is, for example, a brush or a relatively weak shot blast unit or a sucking unit, that is, a cleaning unit configured to remove oil content or dirt adhered to the surface of the PC strand 10 without causing damage on the plated layer.

The coating process B includes a heating device 17, a powder coating device 18, and a cooling device 19 provided in a partitioned state. The heating device 17 employs, for example, a high-frequency induction heating system, in order to achieve an efficient and uniform heating over the entire surface. The powder coating device 18 employs, for example, an electrostatic powder coating system, in which resin powder coating material is adhered uniformly on the outer peripheral surface of the PC strand 10 in the heated state, whereby the resin powder coating material is immediately melted and is formed into a resin coat in the form of coat covering the entire outer peripheral surface. The cooling device 19 is configured to, for example, provide cooling water in the form of shower, which showers the cooling water on the surface of the resin coat formed by the powder coating device 18 to cause the same to cure, and cools the PC strand 10.

Figure 5:
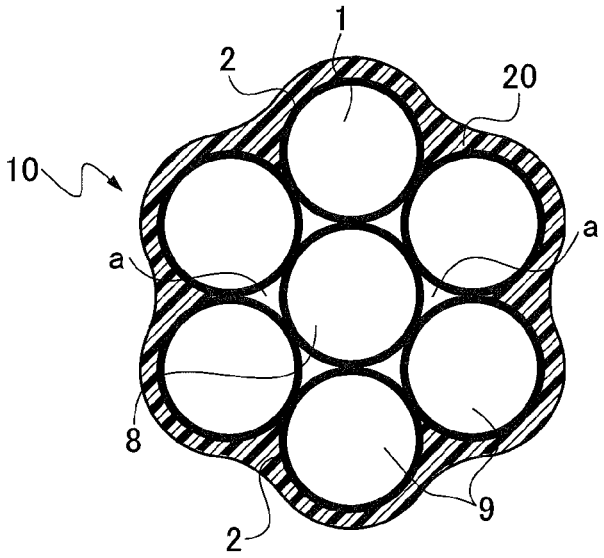
FIG. 5 is an enlarged cross-sectional view of the PC strand after having formed the secondary rustproof coating manufactured in the first embodiment.

By the coating process B, as shown in FIG. 5, a resin coat 20 is formed so as to cover the outer peripheral surface of the PC strand 10 entirely, and the resin coat 20 covers the primary rustproof plated layer 2 formed on the surrounding wires 9 of the PC strand 10 to be the secondary rustproof coating. In this case, although gaps "a" are formed between the core wire 8 and the surrounding wires 9, the gaps "a" are surrounded by the plated layer 2 and the resin coat 20, and are isolated from the outside, so that there arises no problem.

After the coating process B, the inspection process C is preformed. This inspection process includes a thickness inspecting device 21 and a pinhole inspecting device 22, in which an inspection whether or not the resin coat 20 formed in the coating process B has a predetermined thickness and an inspection whether there is a pinhole or not are performed. When the fact that the resin coat 20 does not have the predetermined thickness is detected, it is notified by issuing an alarm and when the pinhole is found, the corresponding portion is marked automatically.

Figure 6:
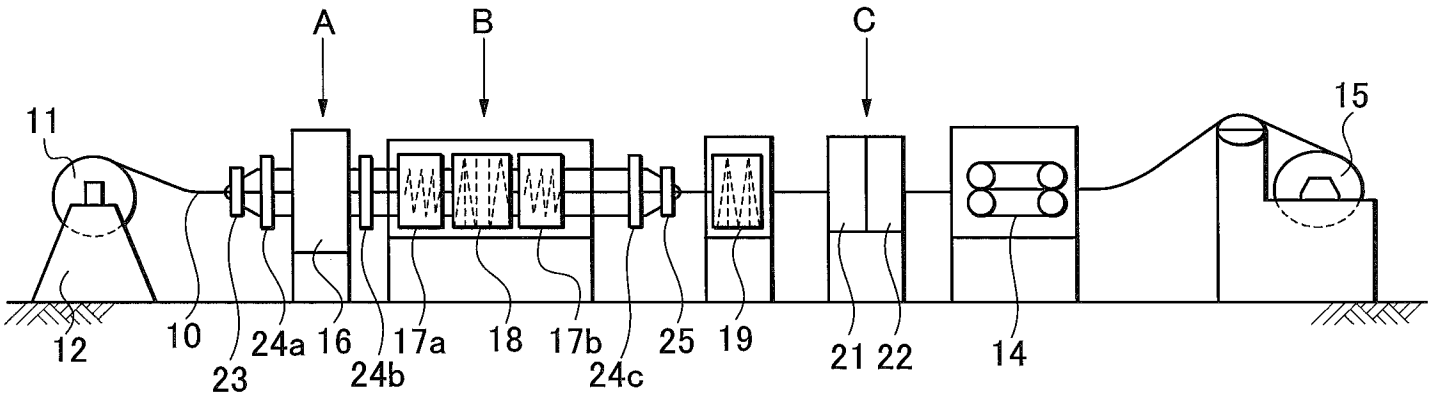
FIG. 6 is a schematic side view showing a process of forming a secondary rustproof coating on the PC strand according to a second embodiment of the invention using the PC strand having the plated layers.
Figure 7:
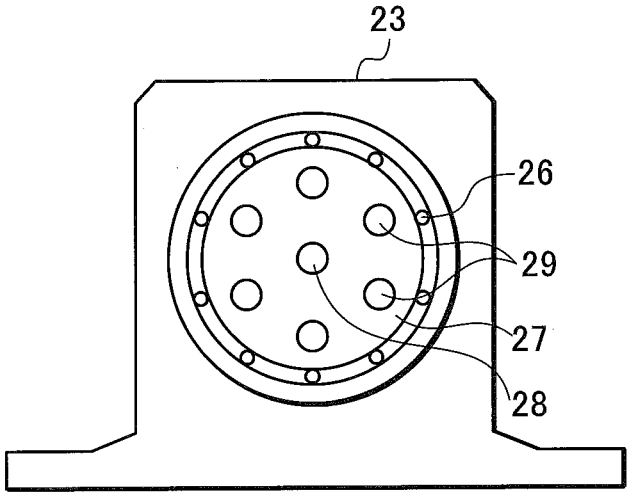
FIG. 7 is a front view showing a loosening device used in a process according to the second embodiment.
Figure 8:
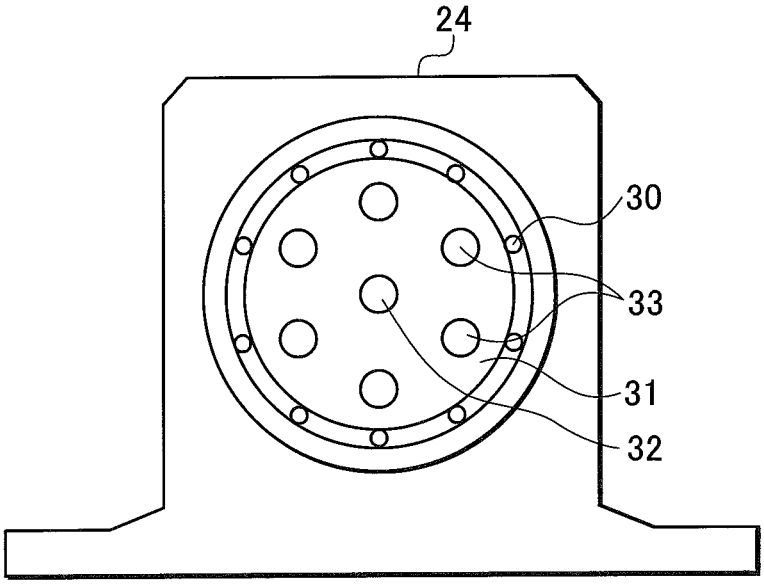
FIG. 8 is a front view showing a spread state maintaining device used in the process according to the second embodiment.

In the process of the processing line according to the second embodiment, an apparatus shown in FIG. 6 to FIG. 8 is used. The same component as those in the first embodiment are designated by the same reference numerals in the description.

On the beginning end side, the PC strand 10 wound around the reel 11 is set on the mount 12, and the PC strand 10 is subjected to the respective processes for the rustproof coat forming and processing, that is, the pretreatment process A, and the coating process B, at a predetermined constant speed while maintaining a state in which the surrounding wires 9 are untwisted and loosened from the core wire 8 and spread, and then the surrounding wires 9 are re-twisted into the original twisted state with respect to the core wire 8, then, the PC strand 10 is transferred to the inspection process C, and wound on the winding reel 15 from the drawing unit 14 on the terminal side.

As a device for maintaining the state in which the surrounding wires 9 are untwisted, loosened and spread from the core wire 8, a loosening device 23 shown in FIG. 7 and plural spread state maintaining devices 24*a* to 24*c* shown in FIG. 8 are necessary. Simultaneously, although not illustrated in detail, a re-twisting device 25 for restoring the PC strand 10 to the original twisted state is necessary.

The loosening device 23 is disposed so that a spinning disk 27 is rotatable via a bearing 26. The spinning disk 27 is formed with a core wire passing hole 28 which allows insertion and passage of the core wire 8 at a center portion thereof, and with surrounding wire passing holes 29 which allow insertion and passage of the respective six surrounding wires 9 radially at a required distance from the core wire passing hole 28. The re-twisting, device 25 has substantially the same configuration as the loosening device 23 and is set in the opposite direction from the loosening device 23 in the operating state.

The spread state maintaining devices 24*a* to 24*c* have substantially the same configuration as the loosening device 23, is formed to have a slightly larger diameter, and each includes a spinning disk 31 disposed so as to be rotatable via a bearing 30. The spinning disk 31 is formed with a core wire passing hole 32 which allows insertion and passage of the core wire 8 at a center portion thereof, and with surrounding wire passing holes 33 which allow insertion and passage of the respective six surrounding wires 9 radially at a required distance from the core wire passing hole 32. The different point from the loosening device 23 is that the distance between the core wire passing hole 32 and the surrounding wire passing holes 33 is larger, and the size of the respective holes is substantially the same.

Then, the loosening device 23 and the spread state maintaining device 24*a* are disposed before the pretreatment process A in order to maintain the state in which the surrounding wires 9 are loosened and spread from the core wire 8 of the PC strand 10 set on the beginning end side. The pretreatment process A includes the cleaning device 16, which is substantially the same as that in the first embodiment. The spread state maintaining device 24*b* is disposed between the pretreatment process A and the coating process B. The spread state maintaining device 24*c* is disposed after the coating process B. In addition, the re-twisting device 25 having the same configuration as the loosening device 23 is disposed after the spread state maintaining device 24*c* in the opposite direction.

Then, the cooling device 19 using cold water configured to have the same configuration as that described above, the inspection process C, the drawing unit 14, and the winding reel 15 are disposed after the re-twisting device 25.

The coating process B includes a preheating device 17*a*, a powder coating device 18, and a post-heating device 17*b*, and the heating device employs the high-frequency induction heating system in the same manner as described above, and the powder coating device 18 employs the electrostatic powder coating system.

With this configuration, the surrounding wires 9 of the PC strand 10 set on the beginning end side are untwisted and loosened from the core wire 8 by the loosening device 23, then the process of performing the rustproof coat forming and processing at a predetermined constant speed while maintaining the state of being spread by the spread state maintaining devices 24*a* to 24*c*, that is, the pretreatment process A and the coating process B are performed.

In this case, since the PC strand 10 is caused to pass through the pretreatment process A in a state in which the surrounding wires 9 are untwisted from the core wire 8 and are spread, the entire peripheral surfaces of the core wire 8 and the respective surrounding wires 9 are cleaned, and then the PC strand 10 is transferred to the coating process B. In the coating process B, since the resin powder is electrostatically coated in a state in which the core wire 8 and the surrounding wires 9 are heated by the preheating device 17*a*, the resin powder is adhered to the outer peripheral surfaces of the core wire 8 and the respective surrounding wires 9 substantially uniformly, and the adhered resin powder is immediately melted and is formed into the form of a coat. Furthermore, the PC strand 10 passes through the coating process B in a state in which the resin coat is sufficiently melted by being heated continuously by the post-heating device 17*b*, and is restored to its original twisted state by the re-twisting device 25 while the resin coat is in the melted state.

By being twisted to the original state, a state in which outer peripheral surfaces of the surrounding wires 9 with respect to the outer peripheral surface of the core wire 8 and the outer surfaces of the surrounding wires 9 with respect to each other are partly brought into mutual abutment is resulted. Therefore, the resin coat in the melted state is pushed out respectively from the portions of abutment between the core wire 8 and the surrounding wires 9 and from the portions of mutual abutment between the surrounding wires 9, and hence is connected on the outer surfaces which are not in abutment as a series of coat having a predetermined thickness. In addition, the gaps a generated between the core wire 8 and the surrounding wires 9 in the first embodiment described above are entirely filled with the melted resin.

Figure 9:
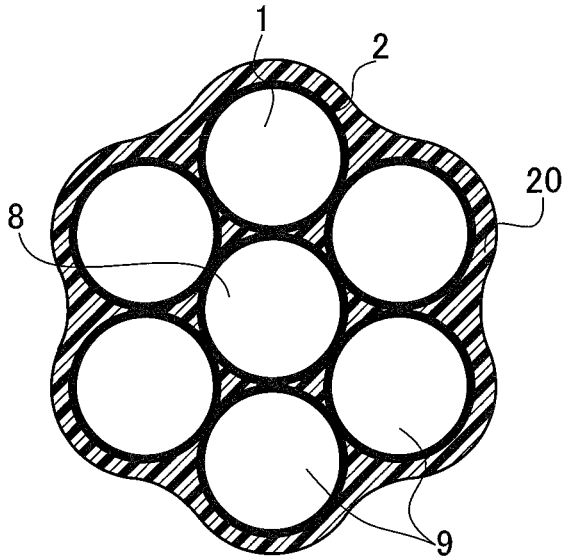
FIG. 9 is an enlarged cross-sectional view of the PC strand after having formed the secondary rustproof coating manufactured in the second embodiment.

Subsequently, the cooling water is sprayed by the cooling device 19 to cool the core wire 8, the surrounding wires 9 and the resin coat 20, so that the PC strand 10 subjected to the double rustproof treatment with the resin filled in the interior of the twisted portion as shown in FIG. 9 is obtained. The inspection process C and the subsequent drawing or winding are the same as in the first embodiment, and overlapped description will be omitted.

In the first and second embodiments, since the helical groove portions of the PC strand 10 is susceptible to formation of the pinhole, at least a thickness of 400 μm is required for the resin coat 20 formed on the outer peripheral surface of the PC strand, and a thickness of 800 to 1200 μm is preferable.

Figure 10:
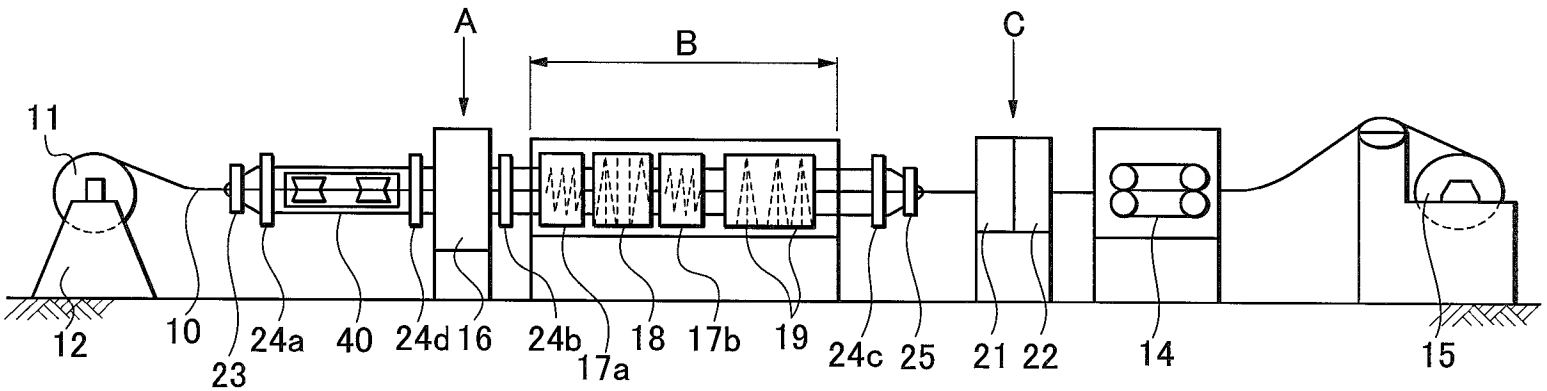
FIG. 10 is a schematic side view showing a process of forming a secondary rustproof coating on the PC strand according to a third embodiment of the invention using the PC strand having the plated layers.
Figure 11:
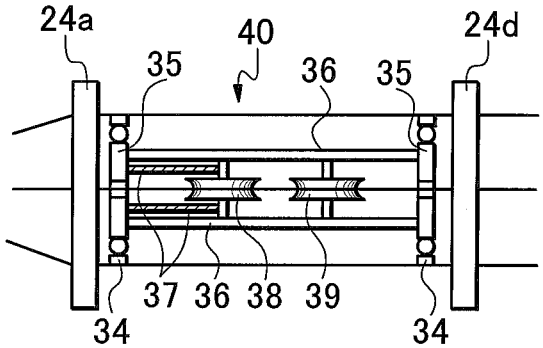
FIG. 11 is a side view showing a core wire adjusting device used in the process according to the third embodiment.

In addition, in the process of the processing line according to a third embodiment, an apparatus shown in FIG. 10 to FIG. 11 is used. The same components as those in the first and second embodiments are designated by the same reference numerals in the description.

The configuration is the same as the second embodiment in that the PC strand 10 wound around the reel 11 is set on the mount 12 on the beginning end side, and the PC strand 10 is subjected to the respective processes for the rustproof coat forming and processing, that is, the pretreatment process A, and the coating process B, at a predetermined constant speed while maintaining a state in which the surrounding wires 9 are untwisted and loosened from the core wire 8 and spread, and then the surrounding wires 9 are re-twisted into the original twisted state with respect to the core wire 8, then, the PC strand 10 is transferred to the inspecting process C, and is wound on the winding reel 15 from the drawing unit 14 on the terminal side. However, in this embodiment, a core wire adjusting device 40 and a spread state maintaining device 24*d* are further required.

In other words, the core wire adjusting device 40 is disposed between the spread state maintaining device 24*a* and the added spread state maintaining device 24*d* between the mount 12 and the pretreatment process A, and the core wire adjusting device 40 includes a pair of supporting disks 35 each having an outer ring 34, plural supporting arms 36 configured to maintain the supporting disks 35 at a predetermined distance in the fore-and-aft direction, and a movable pulley 38 and a fixed pulley 39 mounted on the supporting arms 36 and pulled toward the beginning end side by the spring 37.

Then, the core wire 8 drawn from the PC strand 10 is attached and rotated around the fixed pulley 39 first and then around the movable pulley 38, and is drawn toward the pretreatment process A side, and is transferred continuously at a preset constant speed to the sides of the coating process B and the inspection process C. Meanwhile, uniform and independent resin coating (coating film) is formed on the outer peripheral surfaces of the core wire 8 and the surrounding wires 9 respectively, and the PC strand 10 is wound in an original twisted state.

In the case of this embodiment, the coating process B is different from the second embodiment. In other words, the coating process B is the same in that the preheating device 17*a* and the post-heating device 17*b* are provided before and after the powder coating device 18. However, the cooling device 19 is disposed after the post-heating device 17*b*. Since the core wire 8 and the surrounding wires 9 are electrostatically coated with the resin powder in a state in which the core wire 8 and the surrounding wires 9 are heated by the preheating device 17*a*, the resin powder is adhered substantially uniformly to the outer peripheral surfaces of the core wire 8 and the surrounding wires 9, and the adhered resin powder is immediately melted into the form of a coat. In addition, by being heated continuously by the post-heating device 17*b*, the resin coat is sufficiently melted and is formed uniformly on the outer peripheral surfaces of the core wire 8 and the surrounding wires 9, and then is cooled by the cooling water subsequently by the cooling device 19. Accordingly, the individual and independent resin coatings are formed on the respective outer peripheral surfaces of the core wire 8 and the surrounding wires 9.

Figure 12:
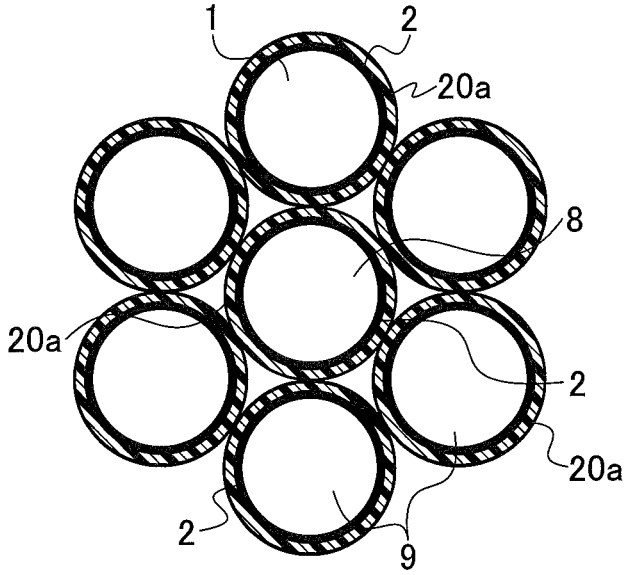
FIG. 12 is an enlarged cross-sectional view of the PC strand after having formed the secondary rustproof coating manufactured in the third embodiment.

In this manner, in the coating process B, the PC strand is fed after having formed the individual and independent resin coatings on the respective outer peripheral surfaces of the core wire 8 and the surrounding wires 9, and is twisted again to the original twisted state by the adjacent re-twisting device 25. As shown in FIG. 12, secondary rustproof resin coatings 20*a* that coat individually the primary rustproof plated layers 2 are formed on the respective outer peripheral surfaces of the core wire 8 and the surrounding wires 9, so that the PC strand 10 having been subjected to the double rustproof treatment is obtained.

Also, the film thickness of smaller than 100 μm may cause the formation of the pinhole. Therefore, the thickness of the resin coat 20*a* is set to at least 120 μm and a thickness of 200 μm is most preferable.

The double rustproof PC strand according to the invention is subjected to a double rustproof treatment by being formed with the secondary rustproof resin coat on the primary rustproof plated layer, and hence superior in durability and the service life is dramatically improved, and hence may be used widely in the field of civil engineering and construction.

What is claimed is:

1. A double rustproof PC strand comprising:

a single core wire and six surrounding wires that are made and rustproofed by a process comprising:

(1) a first drawing of said single core wire and said six surrounding wires prior to plating;

(2) plating said single core wire and said six surrounding wires after the first drawing to form a plated layer on each of said single core wire and said six surrounding wires;

(3) a second drawing of said single core wire and said six surrounding wires after the plating so that said single core wire and said six surrounding wires have a diameter relationship with respect to each other that is selected from the group consisting of:

(A) diameter of said single core wire: 4.42±0.05 mm, diameter of each of said six surrounding wires: 4.25±0.05 mm, (B) diameter of said single core wire: 5.22±0.05 mm, diameter of each of said six surrounding wires: 5.06±0.05 mm, and (C) diameter of said single core wire: 5.40±0.05 mm, diameter of each of said six surrounding wires: 5.25±0.05 mm;

(4) twisting said six surrounding wires around said single core wire after the second drawing; and (5) forming a synthetic resin coating by applying resin powder coating material with an electrostatic powder coating system either on an outer peripheral surface of the strand or on each of said single core wire and said six surrounding wires after the plating;

wherein the PC strand has (1) the synthetic resin coating on an outer peripheral surface of the strand or on each of said single core wire and said six surrounding wires; (2) the diameter relationship of said single core wire and said six surrounding wires thereof that is selected from the group consisting of: (A) diameter of said single core wire: 4.42±0.05 mm, diameter of each of said six surrounding wires: 4.25±0.05 mm, (B) diameter of said single core wire: 5.22±0.05 mm, diameter of each of said six surrounding wires: 5.06±0.05 mm, and (C) diameter of said single core wire: 5.40±0.05 mm, diameter of each of said six surrounding wires: 5.25±0.05 mm; and (3) a tensile strength of 1850 $N/mm^2$ or higher.

2. The double rustproof PC strand according to claim 1, wherein gaps between the respective wires formed with the plated layer are filled with synthetic resin.

3. The double rustproof PC strand according to claim 1, wherein the respective wires formed with the plated layer are each formed with the synthetic resin coating on the outer peripheral surface thereof.

4. The double rustproof PC strand according to claim 1, wherein the thickness of the synthetic resin coat is at least 400 μm.

5. The double rustproof PC strand according to claim 3, wherein the thickness of the synthetic resin coat is at least 120 μm.

6. The double rustproof PC strand according to claim 2, wherein the thickness of the synthetic resin coat is at least 400 μm.

* * * * *